US007107681B2

(12) United States Patent
Yura et al.

(10) Patent No.: US 7,107,681 B2
(45) Date of Patent: Sep. 19, 2006

(54) HEATING ROLLER, METHOD OF PRODUCING THE HEATING ROLLER, AND HEATING DEVICE, FIXING DEVICE AND IMAGE FORMING APPARATUS USING THE HEATING ROLLER

(75) Inventors: Jun Yura, Yokohama (JP); Takashi Fujita, Tokyo (JP); Hirokazu Ikenoue, Inagi (JP); Atsushi Nakafuji, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 143 days.

(21) Appl. No.: 10/624,573

(22) Filed: Jul. 23, 2003

(65) Prior Publication Data

US 2004/0111888 A1 Jun. 17, 2004

Related U.S. Application Data

(62) Division of application No. 09/874,990, filed on Jun. 7, 2001, now Pat. No. 6,636,718.

(30) Foreign Application Priority Data

Jun. 22, 2000 (JP) ..... 2000-187045
May 11, 2001 (JP) ..... 2001-141459

(51) Int. Cl.
*B21K 1/02* (2006.01)

(52) U.S. Cl. ..... 29/895.3; 29/893.33

(58) Field of Classification Search ..... 29/895, 29/895.33, 895.3; 492/27, 6, 7, 17, 38; 432/60; 399/95, 330, 331, 333, 334; 101/328; 219/469
See application file for complete search history.

(56) References Cited

U.S. PATENT DOCUMENTS

| | | | | |
|---|---|---|---|---|
| 242,058 | A * | 5/1881 | Schurmann | 492/6 |
| 3,019,511 | A * | 2/1962 | Hornbostel | 492/6 |
| 3,884,623 | A * | 5/1975 | Slack | 432/60 |
| 3,999,038 | A * | 12/1976 | Sikes et al. | 432/60 |
| 4,042,804 | A * | 8/1977 | Moser | 219/216 |
| 4,594,068 | A * | 6/1986 | Bardutzky et al. | 432/60 |
| 4,768,050 | A * | 8/1988 | Beery | 396/583 |
| 5,070,231 | A * | 12/1991 | Bacus et al. | 219/216 |
| 5,092,235 | A * | 3/1992 | Rise | 100/168 |
| 5,195,430 | A * | 3/1993 | Rise | 100/168 |
| 5,538,677 | A * | 7/1996 | Takahashi | 264/221 |
| 5,689,788 | A * | 11/1997 | Moser | 399/328 |
| 5,802,443 | A * | 9/1998 | Matsumoto et al. | 399/333 |
| 6,118,969 | A * | 9/2000 | Curry et al. | 399/334 |

(Continued)

FOREIGN PATENT DOCUMENTS

JP 56-019066 * 2/1981

(Continued)

OTHER PUBLICATIONS

U.S. Appl. No. 10/960,049, filed Oct. 8, 2004, Yasutomi et al.

(Continued)

*Primary Examiner*—Eric Compton
(74) *Attorney, Agent, or Firm*—Oblon, Spivak, McClelland, Maier & Neustadt, P.C.

(57) ABSTRACT

A heating roller including a core of hollow cylinder form and wherein a thickness of the core is thicker in a center portion thereof than in both end portions thereof. Further, a heating device may have the heating roller, a fixing device may have the heating roller and the heating device, and an image forming apparatus may have the heating roller, the heating device and the fixing device.

3 Claims, 7 Drawing Sheets

U.S. PATENT DOCUMENTS 6,157,805 A * 12/2000 Haneda et al. ..... 399/328
2004/0111888 A1 6/2004 Yura et al.

FOREIGN PATENT DOCUMENTS

JP 57-155572 * 9/1982
JP 58-184173 * 10/1983
JP 59-191078 * 10/1984
JP 02-262684 * 10/1990
JP 03-065977 * 3/1991
JP 07-281546 * 10/1995
JP 08-030128 * 2/1996
JP 09-034296 * 2/1997
JP 09-152803 * 6/1997
JP 09-244448 * 9/1997
JP 10-039665 * 2/1998
JP 10-228201 * 8/1998
JP 2000-029342 * 1/2000

OTHER PUBLICATIONS

U.S. Appl. No. 10/998,089, filed Nov. 29, 2004, Nakafuji et al.
U.S. Appl. No. 11/128,363, filed May 13, 2005, Yura et al.
U.S. Appl. No. 11/165,021, filed Jun. 24, 2005, Baba et al.
U.S. Appl. No. 11/177,330, filed Jul. 11, 2005, Someya et al.

* cited by examiner

HEATING ROLLER, METHOD OF PRODUCING THE HEATING ROLLER, AND HEATING DEVICE, FIXING DEVICE AND IMAGE FORMING APPARATUS USING THE HEATING ROLLER

This application is a Division of application Ser. No. 09/874,990 Filed on Jun. 7, 2001 now U.S. Pat. No. 6,636, 718

BACKGROUND OF THE INVENTION

1. Field of the Invention

The present invention relates to a heating roller of a hollow cylinder form, a heating device having the heating roller, a fixing device having the heating roller or the heating device, an image forming apparatus such as a copying machine, a facsimile machine, a printer, and a printing machine having the heating roller, the heating device or the fixing device, and a method of producing the heating roller.

2. Discussion of the Background

An image forming apparatus such as a copying machine, a facsimile machine, a printer and a printing machine generally includes a fixing device having a heating roller of a hollow cylinder form. The fixing device is a mechanism for fixing a toner image transferred onto a sheet.

The heating roller is made of metal in general, and is thinned for decreasing the heat capacity thereof so that heat response property thereof relative to a heating device which heats the heating roller can be improved. However, because of the thinning, the rigidity of the heating roller is decreased. When a heating roller 118 is used in a fixing device 116 illustrated in FIGS. 9, 10 and 11, a pressing roller 119 illustrated in FIGS. 9, 10 and 11 press-contacts the heating roller. Therefore, a bend is caused in the longitudinal direction of the heating roller 118 as illustrated in FIG. 9, or a crush is caused in the vertical direction of the shaft of the heating roller 118 as illustrated in FIG. 10. When the bend or the crush is caused in the heating roller 118, a gap is caused at a nip portion between the heating roller 118 and the pressing roller 119 as illustrated in FIG. 11, the bend or the crush becomes maximum in the center portion of the heating roller in the longitudinal direction thereof, and a nip width in a sheet-passing direction of the center portion becomes narrow. When the nip width thereof becomes narrow, a heat amount which is supplied to a transfer member, to which a toner image is transferred and which passes between the heating roller 118 and the pressing roller 119, becomes small, and a fixing failure occurs.

Such a failure becomes remarkable when the outside diameter of the heating roller 118 in the center portion in the longitudinal direction thereof is made smaller than that in both end portions in the longitudinal direction thereof in order to prevent wrinkles of the transfer member when the transfer member passes the nip portion. The failure becomes especially remarkable when the thickness of the heat roller 118 in the center portion thereof is made smaller than that in both end portions by cutting the outer circumference surface of the center portion.

In Japanese Laid-Open Patent Publication 10-228201, a technique has been proposed to perform material processing-hardening by adding an external force to the inner circumference surface and the outer circumference surface of a heating roller so that the strength of a heating roller is improved by the processing-hardening during material deformation. Further, in Japanese Laid-Open Patent Publication 10-039665, a technique has been proposed such that the strength of a heating roller is improved by forming a rib in the inner circumference surface of the heating roller.

However, an apparatus using the technique proposed in Japanese Laid-Open Patent Publication 10-228201 is large and has low productivity. Moreover, in the technique in Japanese Laid-Open Patent Publication 10-039665, the heat capacity of a heating roller is increased in the portion thereof in which the rib is formed, and thereby it is difficult to maintain a uniform temperature of the heating roller as the temperature is rising.

SUMMARY OF THE INVENTION

Preferred embodiments of the present invention provide a heating roller in which a bend or a crush is not caused to suppress the increase of heat capacity, even when a thin heating roller is used, and manufacturing can be relatively easily performed. The preferred embodiments of the present invention provide a heating device having the heating roller, a fixing device having the heating roller and a heating device, and an image forming apparatus such as a copying machine, a facsimile machine, a printer and a printing machine, etc. having the heating roller, the heating device or the fixing device, and a method of producing the heating roller.

According to a preferred embodiment of the present invention, a heating roller includes a core of hollow cylinder form, wherein a thickness of the core is greater in a center portion thereof than in both end portions thereof.

Further, in the heating roller, an inside diameter of the core is smaller in the center portion thereof than in the end portions thereof.

Further, in the heating roller, an outside diameter of the core is substantially constant in a shaft direction of the core.

Further, in the heating roller, an outside diameter of the core is smaller in the center portion thereof than in the end portions thereof.

Further, in the heating roller, the thickness of the core continuously increases from the end portions thereof toward the center portion thereof.

Further, in the heating roller, a difference of the thickness of the core between the end portions and the center portion thereof is set such that a nip width of the center portion thereof is substantially the same as that of the end portions thereof, and such that a difference of a temperature in a longitudinal direction of the heating roller, when the temperature is rising, is within a predetermined range.

According to another preferred embodiment of the present invention, a method of producing a heating roller includes drawing a core of hollow cylinder form, and cutting an outer circumference surface of the core, wherein a thickness of the core is greater in a center portion thereof than in both end portions thereof.

Further, in the method of producing a heating roller, during drawing, the core is drawn is such that an inside diameter of the core is smaller in the center portion thereof than in the end portions thereof.

Further, in the method of producing a heating roller, during cutting, the core is cut such that an outside diameter of the core is substantially constant in a shaft direction of the core.

Further, in the method of producing a heating roller, during cutting, the core is cut such that an outside diameter of the core is smaller in the center portion thereof than in the end portions thereof.

According to another preferred embodiment of the present invention, a heating device including a heating roller includes a core of hollow cylinder form, and a thickness of the core is greater in a center portion thereof than in both end portions thereof, and a heating element is configured to heat the heating roller.

Further, in the heating device, an inside diameter of the core of the heating roller is smaller in the center portion thereof than in the end portions thereof.

Further, in the heating device, an outside diameter of the core of the heating roller is substantially constant in a shaft direction of the core.

Further, in the heating device, an outside diameter of the core of the heating roller is smaller in the center portion thereof than in the end portions thereof.

Further, in the heating device, the thickness of the core of the heating roller continuously increases from both end portions thereof toward the center portion thereof.

Further, in the heating device, a difference of the thickness of the core of the heating roller between both end portions and the center portion thereof is set such that a nip width of the center portion thereof is substantially the same as that of the end portions thereof, and such that a difference of a temperature in a longitudinal direction of the heating roller, when the temperature is rising, is within a predetermined range.

According to another preferred embodiment of the present invention, a fixing device including a heating roller includes a core of hollow cylinder form, a thickness of the core is greater in a center portion thereof than in both end portions thereof, and a pressing roller is configured to contact-press the heating roller.

Further, in the fixing device, an inside diameter of the core of the heating roller is smaller in the center portion thereof than in the end portions thereof.

Further, in the fixing device, an outside diameter of the core of the heating roller is substantially constant in a shaft direction of the core.

Further, in the fixing device, an outside diameter of the core of the heating roller is smaller in the center portion thereof than in the end portions thereof.

Further, in the fixing device, the thickness of the core of the heating roller continuously increases from both end portions thereof toward the center portion thereof.

Further, in the fixing device, a difference of the thickness of the core of the heating roller between the end portions and the center portion thereof is set such that a nip width of the center portion thereof is substantially the same as that of the end portions thereof, and such that a difference of a temperature in a longitudinal direction of the heating roller, when the temperature is rising, is within a predetermined range.

According to another preferred embodiment of the present invention, the fixing device includes a heating device including a heating roller including a core of hollow cylinder form, wherein a thickness of the core is greater in a center portion thereof than in both end portions thereof, and a heating element configured to heat the heating roller. A pressing roller is configured to contact-press the heating roller.

Further, in the heating device, an inside diameter of the core of the heating roller is smaller in the center portion thereof than in the end portions thereof.

Further, in the heating device, an outside diameter of the core of the heating roller is substantially constant in a shaft direction of the core.

Further, in the heating device, an outside diameter of the core of the heating roller is smaller in the center portion thereof than in the end portions thereof.

Further, in the heating device, the thickness of the core of the heating roller continuously increases from both end portions thereof toward the center portion thereof.

Further, in the heating device, a difference of the thickness of the core of the heating roller between the end portions and the center portion thereof is set such that a nip width of the center portion thereof is substantially the same as that of the end portions thereof, and such that a difference of a temperature in a longitudinal direction of the heating roller, when the temperature is rising, is within a predetermined range.

According to another preferred embodiment of the present invention, an image forming apparatus includes a photoconductive member, a charger configured to charge the photoconductive member, an exposure device configured to form an electrostatic image on the photoconductive member, a developing device configured to develop the electrostatic image on the photoconductive member, a transfer device configured to transfer the developed image onto a sheet-like medium, and a fixing device configured to fix the transferred image onto the sheet-like medium, the fixing device including a heating roller including a core of hollow cylinder form, a thickness of the core being greater in a center portion thereof than in end portions thereof, a heating element configured to heat the heating roller, and a pressing roller configured to contact-press the heating roller.

Further, in the image forming apparatus, an inside diameter of the core of the heating roller is smaller in the center portion thereof than in the end portions thereof.

Further, in the image forming apparatus, an outside diameter of the core of the heating roller is substantially constant in a shaft direction of the core.

Further, in the image forming apparatus, an outside diameter of the core of the heating roller is smaller in the center portion thereof than in the end portions thereof.

Further, in the image forming apparatus, the thickness of the core of the heating roller continuously increases from the end portions thereof toward the center portion thereof.

Further, in the image forming apparatus, a difference of the thickness of the core of the heating roller between the end portions and the center portion thereof is set such that a nip width of the center portion thereof is substantially the same as that of the end portions thereof, and such that a difference of a temperature in a longitudinal direction of the heating roller, when the temperature is rising, is within a predetermined range.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DESCRIPTION OF THE PREFERRED EMBODIMENTS

Figure 1:
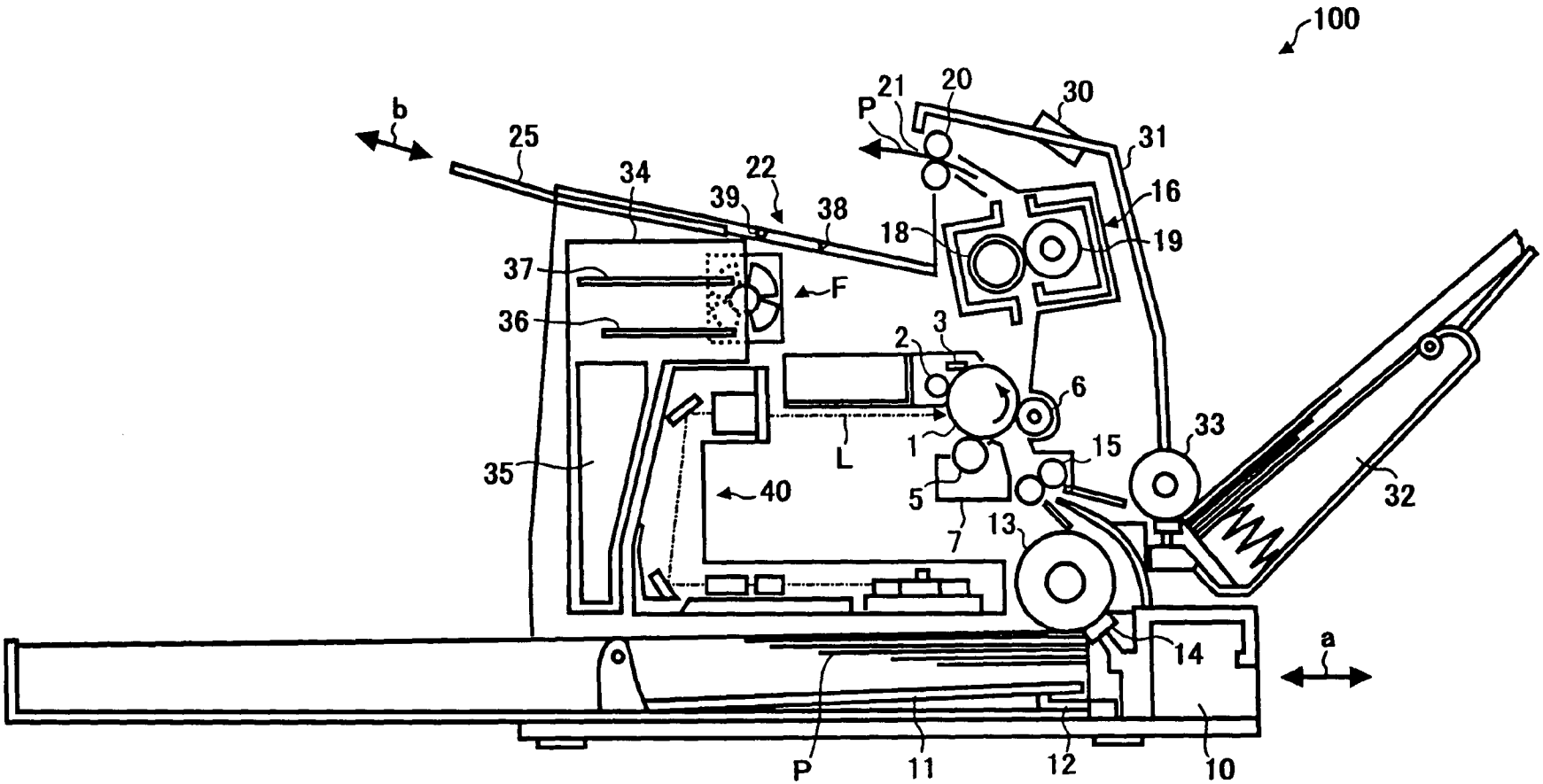
FIG. 1 is a schematic side view illustrating a heating roller, a heating device having the heating roller, a fixing device having the heating roller, heating device and fixing device, and an image forming apparatus having the heating roller, heating device and fixing device of the present invention.

Referring now to the drawings, wherein like reference numerals designate identical or corresponding parts throughout the several views, preferred embodiments of the present invention are described.

As illustrated in FIG. 1, an image forming apparatus 100, functioning as a copying machine to which the present invention is applied, has a photoconductive member 1 which rotates in an arrow sign direction. A charger 2, a cleaner 3, a developing device 7 including a developing sleeve 5 which visualizes an electrostatic latent image on the photoconductive member 1 by supplying a toner, and a transfer device 6 are arranged around the photoconductive member 1. Numeral 40 indicates a laser optical system in which a laser beam L is irradiated and scanned on the photoconductive member 1 between the developing device 7 and the charger 2 and thereby optical writing is performed.

At a lower portion of the image forming apparatus 100 a paper feed cassette 10 is provided so as to be detachable in an arrow sign direction "a". A sheet P serving as a member onto which a toner image is transferred is stored in a paper feed cassette 10. The sheet P is held by a lower board 11 and is pressed to a paper feed roller 13 by way of an arm 12 by a force of a spring. According to the rotation of the paper feed roller 13 by a command from a control device 37, an uppermost sheet in the paper cassette 10 is conveyed to a pair of registration rollers 15 at a downstream side thereof. A separation pad 14 prevents plural sheets from being conveyed together.

A fixing device 16 has a heating roller 18 of a hollow cylinder form (called a fixing roller in some cases) as a heating member, and a pressing roller 19 which press-contacts and faces the heating roller 18. The sheet P passes a nip portion 46 (see FIG. 3) formed by the rollers 18 and 19, and thereby a toner image is fixed onto the sheet P. A paper ejecting stopper 25 is arranged at the end of the paper ejecting tray 22 so as to be slidable in an arrow sign direction "b", so that the size of the paper ejecting tray 22 corresponds to the size of a sheet to be ejected.

An operation panel 30 is arranged at the right side of the image forming apparatus 100, and projects at a front side of an upper portion (at a right-upper side in the image forming apparatus 100 in FIG. 1) of an exterior cover 31. Further, the paper feed tray 32 is pivotably installed at a hinge 33. In a case 34 arranged at a left side in FIG. 1 are stored a control device 37 (a controller board) and electric devices, such as a power source 35 and a print board 36 (an engine driver board). In a backside of the image forming apparatus in FIG. 1 is arranged a fan F as an air flow-generating device for exhausting an air in the image forming apparatus 100 toward outside. A cover 38 constituting the paper ejecting tray 22 can pivot on a pivotable fulcrum 39 so as to be opened.

Figure 2:
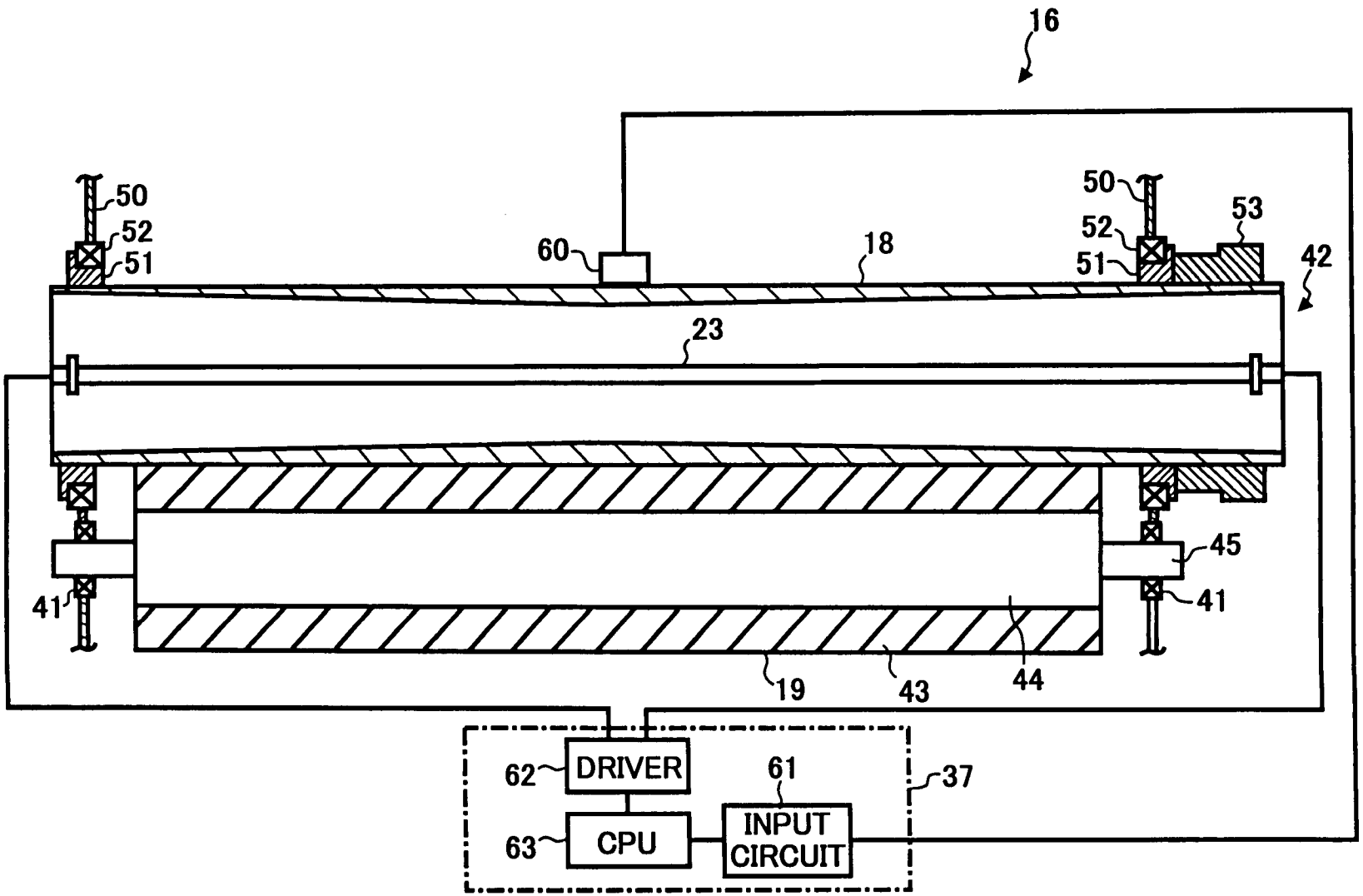
FIG. 2 is a front view illustrating the fixing device shown in FIG. 1.

As illustrated in FIG. 2, the fixing device 16 has the heating roller 18 and the pressing roller 19, which is pressed to the heating roller 18 by a pressing force of a spring. The nip portion 46 (see FIG. 3) is formed between the rollers 18 and 19 by press-contact of the pressing roller 19 to the heating roller 18. The heating roller 18 is attached to fixing side boards 50 and 50 by way of bearings 52 and 52 and heat insulation bushes 51 and 51, and is rotatably driven by a gear 53 which engages with a driving source. A radiation heater 23 as a heating element is inserted through the hollow cylinder portion of the heating roller 18, and the end portions of the radiation heater 23 are held by a heater holding member. The heating roller 18 and the radiation heater 23 form a heating device 42.

The radiation heater 23 is formed from a tungsten filament covered with a glass tube filled with nitrogen or inert gas to prevent oxidation of the filament, and halogen material including iodine, bromine, chlorine or the like. As an alternative configuration for heating the heating roller 18, an exothermic ceramic formed in a pipe form so as to be an exothermic body layer may be integrated with the heating roller 18 at a surface or an inside thereof. Further, a roller pipe itself may be heated by induction heating etc. so that the heating roller 18 itself is heated. On the outer circumference surface of the heating roller 18, a fluorine containing resin-layer of Teflon (polytetrafluoroethylene) coat etc. of approximate 10–30 m is formed in order to heighten the releasing property of an image forming agent such as a toner etc. relative to the heating roller 18.

Figure 3:
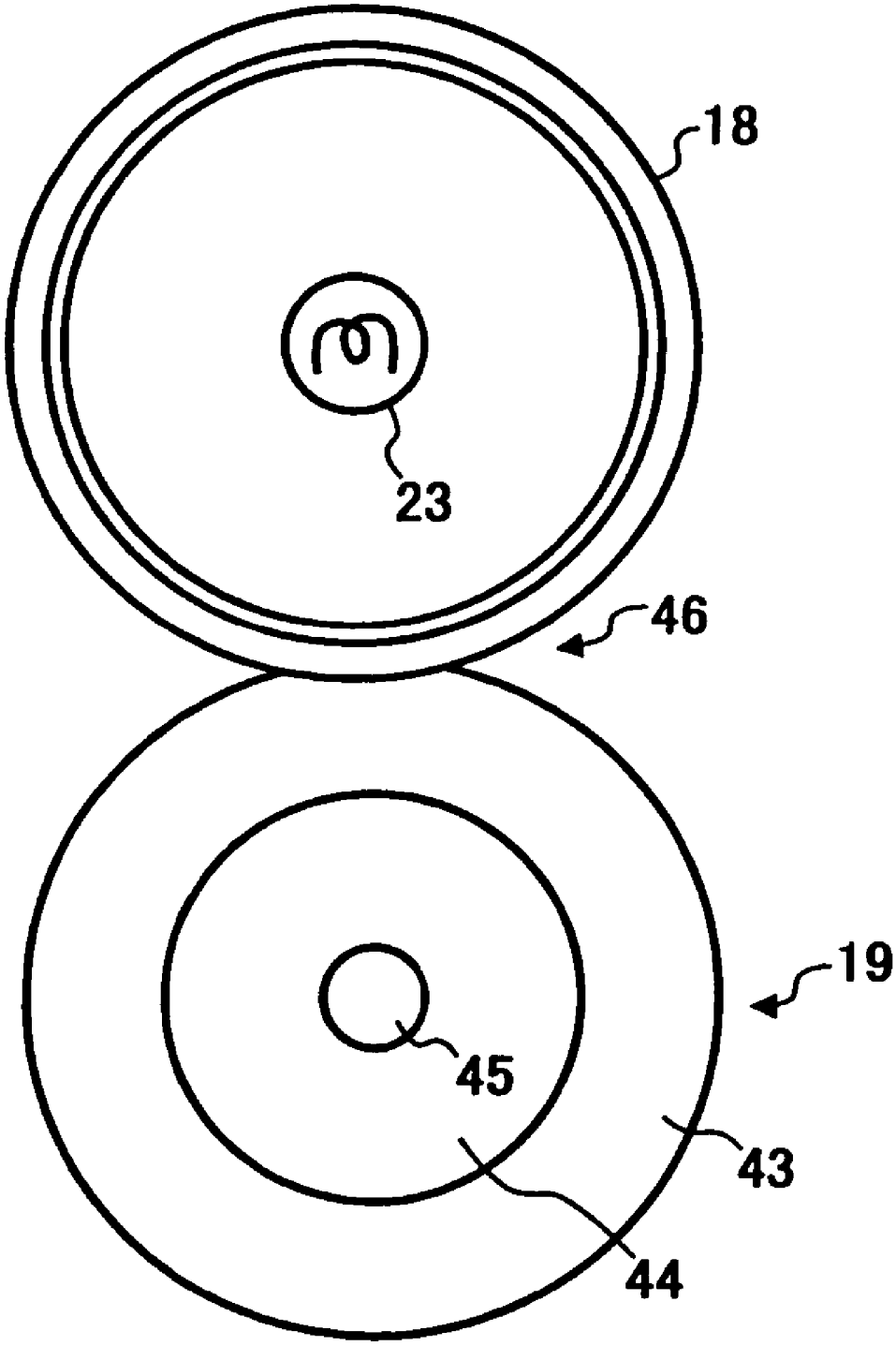
FIG. 3 is a side view illustrating the fixing device shown in FIGS. 1 and 2.

The pressing roller 19 is made of a heat-resisting elastic layer 43 of silicon rubber and a core layer 44 of iron covered with the elastic layer 43. A shaft member 45 of iron integrated with the core layer 44 is attached to the fixing side boards 50 and 50 by way of the bearings 41 and 41 so as to be rotatively supported, as illustrated in FIG. 3. The core layer 44 and the shaft member 45 may be made of aluminum or alloy of mainly iron and aluminum etc. A silicon oil as a releasing agent may be coated on the surface of the pressing roller 19 by a releasing agent-coating device in order to heighten the releasing property. The pressing roller 19 rotates together with the heating roller 18, and the sheet P is passed through the nip portion by the rotation of the rollers 18 and 19 so that a toner image T is fixed onto the sheet P by the heating of the heating roller 18 and the pressing of the pressing device 19. During fixing, the sheet P is conveyed such that the toner image T faces the side of the heating roller 18.

A temperature sensor 60 contacts a surface of the heating roller 18, and a signal detected by the temperature sensor 60 is sent to a CPU 63 by way of an input circuit 61. The CPU 63 is configured so as to control energizing of the radiation heater 23 by way of a driver 62 on the basis of the detected temperature of the heating roller 18. When the power source in the image forming apparatus 100 is turned on, a current flows to the radiation heater 23 by way of the driver 62, and the temperature of the heating roller 18 is rapidly increased to the set temperature of around 180° C.

The heating roller 18 is made of a metal such as iron or aluminum, etc., of a pipe form. However, the heating roller 18 may be made of an alloy of mainly iron or aluminum. The heating roller 18 may be also made of glass, ceramic, or heat resistant-resin, or a part thereof may be made of these materials. Further, the heating roller 18 may be made of a heat resistant insulator such as PPS, liquid crystal polymer or enamel.

The heating roller 18 in this embodiment is formed by only a core. However, when a releasing layer is formed on the surface of the core, the core and the releasing layer constitute the heating roller 18. Therefore, in this embodiment, the heating roller 18 is the core itself.

Figure 4:
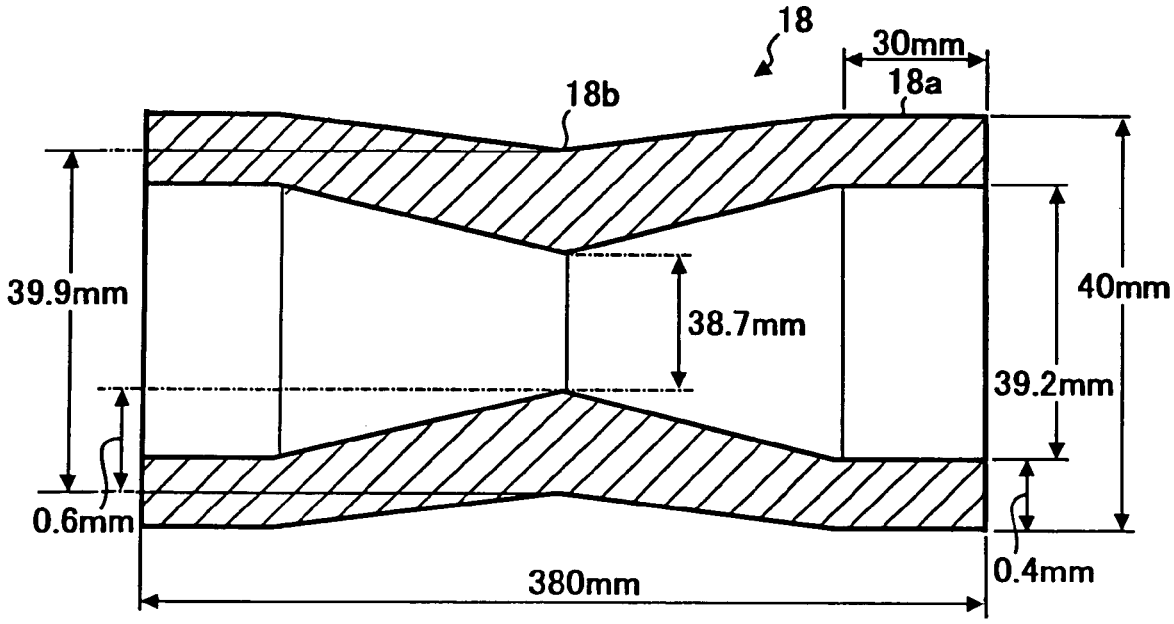
FIG. 4 is a schematic front and sectional view illustrating a heating roller of one embodiment of the present invention.

As is apparent in FIG. 4, with respect to the heating roller 18, the inside diameter of the center portion thereof is smaller than that of both end portions thereof, and the outside diameter of the center portion thereof is smaller than that of both end portions thereof, in the longitudinal direction. Thereby, the thickness of the center portion is greater than that of both end portions. The end portions on which the heat insulation bushes 51 and 51 are arranged are constant in their outer and the inside diameters. However, the thickness continuously increases toward the center portion from both end portions, in a portion between the end portions.

More specifically, the whole length of the heating roller 18 is 380 mm, and the material thereof, i.e. the material of the core, is aluminum. The straight portions 18*a* of the end portions are 30 mm in length, 40 mm in outside diameter, 39.2 mm in inside diameter and 0.4 mm in thickness of the core.

The smallest portion of the outside diameter 18*b* in the center portion is 39.9 mm in outside diameter, 38.7 mm in inside diameter, 0.6 mm in thickness of the core, and the thickness continuously increases toward the center portion of the core. The difference of the outside diameter between the end portions and the center portion is 0.1 mm, and the difference of the thickness of the core between the end portions and the center portion is 0.2 mm.

When the difference of the outside diameter between the end portions and the center portion is too small, wrinkles are caused when a thin sheet is fed. When the difference is too large, errors of an image are caused by the difference of the circumferential speed between the end portions and the center portion. Consequently, the difference of the outside diameter between the end portions and the center portion is determined considering such wrinkles of the sheet and errors of the image, and changes according to the rotation speed, etc. Usually, the difference of the outside diameter between the end portions and the center portion is set within the range of approximate 0.04–0.2 mm.

With respect to the difference of the thickness between the end portions and the center portion, the deformation of the roller 18 can be suppressed and a wide and uniform nip can be obtained by thickening the center portion of the core. However, when the center portion is too thick and the difference between the end portions and the center portion is too large, the heat capacity of the center portion is larger than that of the end portions, and thus the difference of the thickness changes according to the material, the outside diameter and the thickness of the roller core, the load weight of the heating roller, and the electric power of the heater. The above difference of the thickness of the core is set so that the nip widths in a sheet-passing direction of the center portion and the end portions can be uniform, and so that the difference of temperature in the longitudinal direction of the roller during the temperature rising time can be within a predetermined range.

The difference of the thickness of the core between the end portions and the center portion is usually set within the range of approximate 0.06–0.2 mm.

In this embodiment, the outside diameter of the pressing roller 19 is 30 mm, and it press-contacts the heating roller 18 by a load weight of 100 N, and thereby the width of the nip portion 46 is 6 mm. The linear speed is 180 mm/s.

Figure 9:
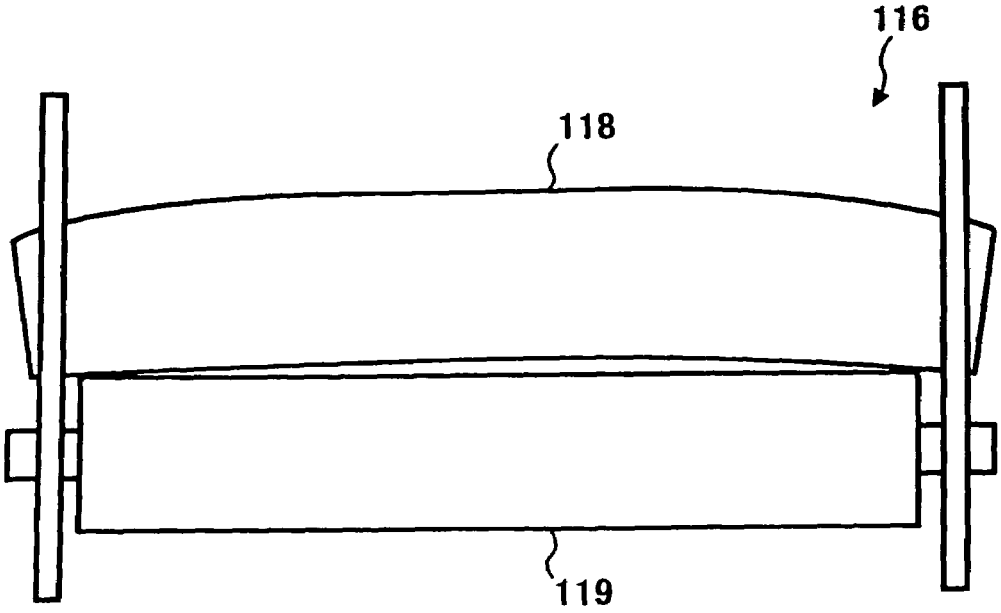
FIG. 9 RELATED ART
FIG. 9 is a front view illustrating a prior art fixing device.
Figure 10:
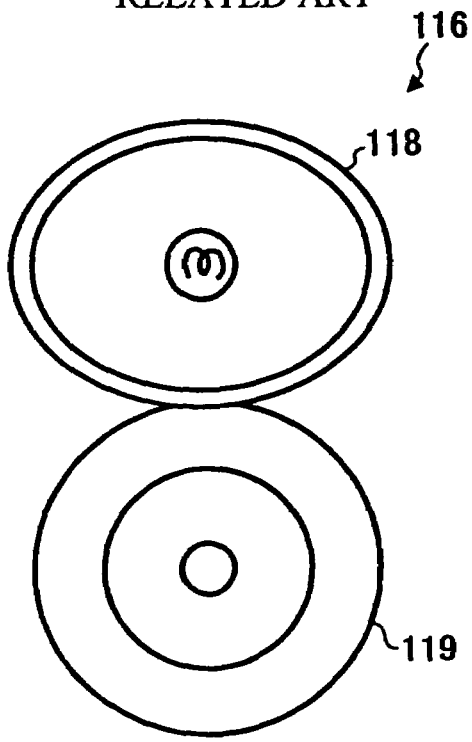
FIG. 10 RELATED ART
FIG. 10 is a side view illustrating a prior art fixing device.
Figure 11:
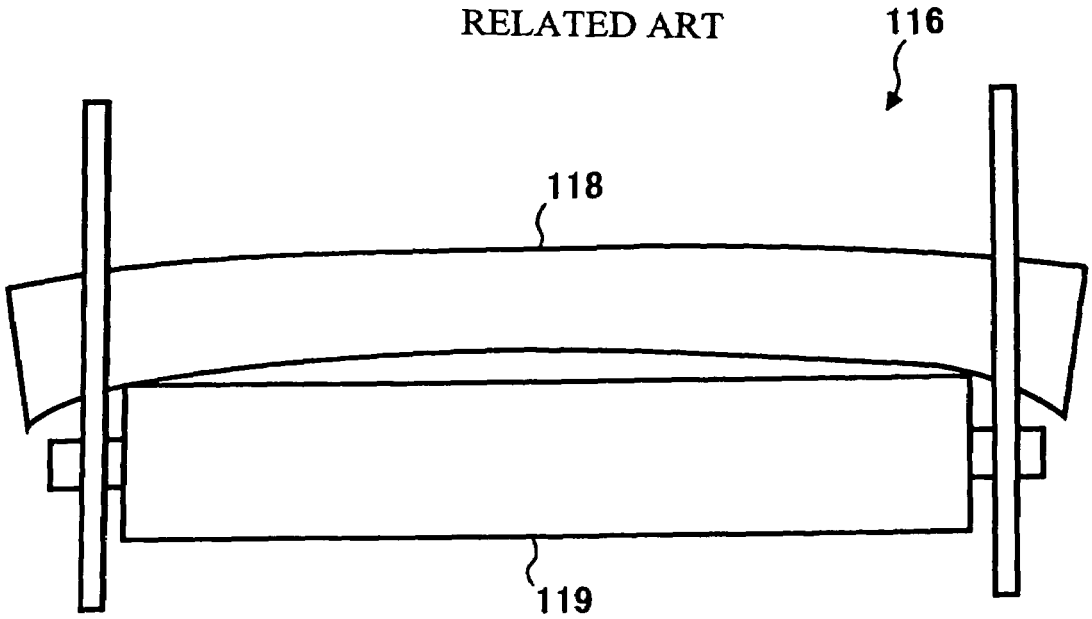
FIG. 11 RELATED ART
FIG. 11 is a front view illustrating a prior art fixing device.

By having such a form with respect to the heating roller 18, the rigidity of the center portion of the heating roller 18 in the longitudinal direction thereof is improved, and the bend illustrated in FIG. 9 or the crush illustrated in FIG. 10 which has conventionally occurred, is not caused. Therefore, the state where the bend or the crush occurs as illustrated in FIG. 10 is not caused, the width of the nip portion 46 is long enough to fix and maintain the state as illustrated in FIGS. 2 and 3.

Figure 5:
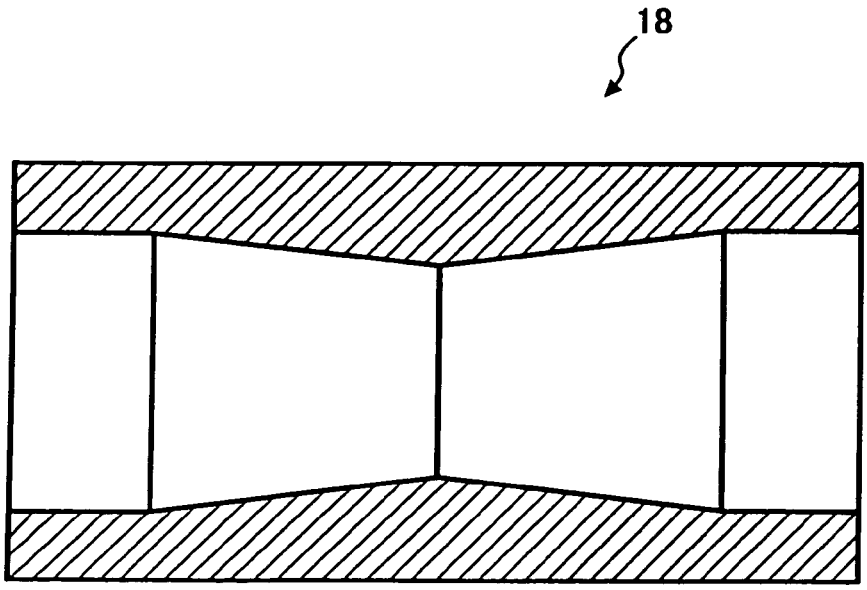
FIG. 5 is a schematic front and sectional view illustrating a heating roller of another embodiment of the present invention.
Figure 7:
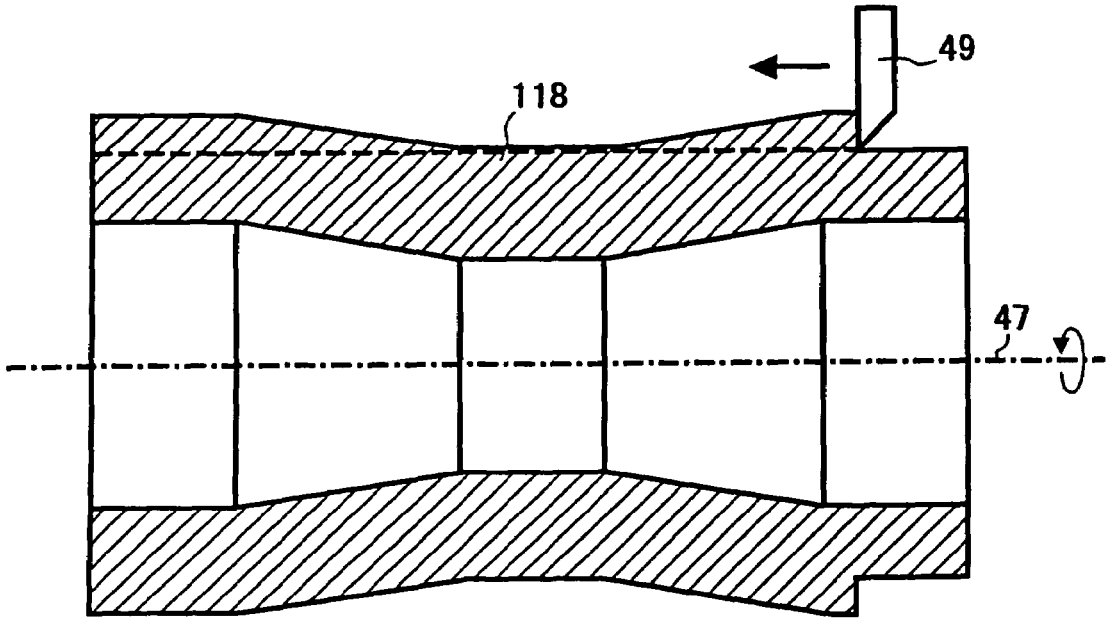
FIG. 7 is a front and sectional view illustrating the cutting process of the producing method of the heating roller of the present invention.

The heating roller 18 in this embodiment is formed in a so-called hand drum form such that the outside diameter of the center portion is smaller than that of both end portions in the longitudinal direction thereof. However, if the thickness of the center portion is thicker than that of the end portions, the outside diameter may be constant as illustrated in FIG. 5, or the diameter of the center portion may be larger than that of the end portions such that the heater roller 18 is formed in a barrel form. Further, the inside diameter of the center portion may have a constant portion as illustrated in FIG. 7. Furthermore, the end portions of the heating roller 18 are not necessarily required to have a uniform thickness. The change of the thickness may be linear or curved. Furthermore, if the partial increase of the heat capacity can be ignored, the change of the thickness may have discontinuous points.

Figure 6:
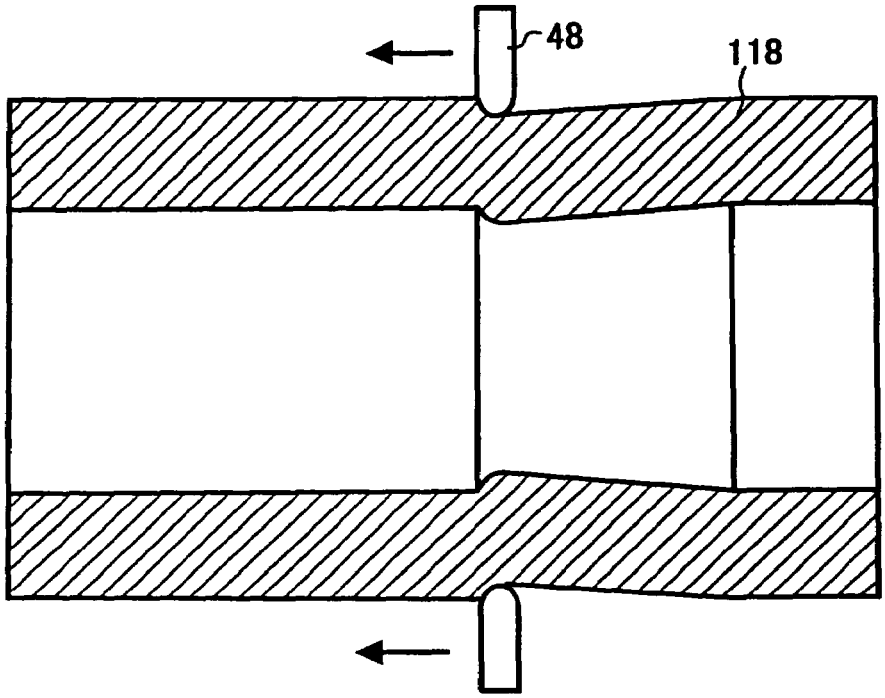
FIG. 6 is a front and sectional view illustrating the drawing process of the producing method of the heating roller of the present invention.

FIGS. 6 and 7 illustrate a method of producing a heating roller in which the inside diameter of the center portion is smaller than that of the end portions. At first, as illustrated in FIG. 6, an outer circumference surface of an original pipe 118, which is a hollow cylinder form and which has constant thickness, is engaged with a ring-like member 48, and the ring-like member 48 and the original pipe 118 are relatively moved in the longitudinal direction thereof. In this process, by changing the diameter of the member 48, drawing is performed so as to make the inside diameter of the center portion smaller than that of the end portions, with the thickness of the original pipe 118 maintained. Consequently, cutting is performed as illustrated in FIG. 7 in which the original pipe 118 is rotated around the shaft 47, and by contacting a blade 49 to the outer circumference surface of the original pipe 118 and by moving the blade 49 and the original pipe 118 relatively in the longitudinal direction of the original pipe 118, the outer circumference surface is cut so that the outside diameter is made to have a predetermined value.

FIG. 7 illustrates a case where the outside diameter of a heating roller is constant. However, a heating roller of a hand drum form as illustrated in FIG. 4 can be produced by changing the distance between the blade 49 and the shaft 47. In FIG. 7, the inside diameter of the original pipe 118 has a constant portion in the center portion thereof. However, by controlling the change of the diameter of the member 48, the original pipe 118 can be formed such that the inside diameter does not have the constant portion in the center portion thereof. Further, the material of the original pipe 118 which can be processed by this producing method is preferably one of those described above such as metal, etc. Moreover, when a layer of fluorine containing resin is formed on the outer circumference surface of the heating roller 18, the layer is formed after the above cutting process.

In the image forming apparatus 100 described above, charging of the photoconductive member 1 with the charger 2, forming of the electrostatic latent image with the laser beam L, developing with the developing device 7, transferring with the transfer device 6, cleaning with the cleaning device 3, and discharging with the discharger, are sequentially performed, and the charging process is performed again in synchronism the rotation in the arrow sign direction of the photoconductive member 1. Further, the sheet P is conveyed from the paper feed cassette 11 or the paper feed tray 32 toward a transfer region where the photoconductive member 1 faces the transfer device 6, and is fed to the transfer region at a timing which synchronizes with the timing of the toner image formation on the photoconductive member 1 by the pair of the registration rollers 15 so that the toner image is formed on the sheet P. The toner image transferred on the sheet P by the transfer process is guided to the nip portion 46 of the fixing device 16, and passes the nip portion 46 due to the rotation of the heating roller 18 and the pressing roller 19.

In the fixing process, the heating roller 18 is directly heated by the thermal radiation of the radiation heater 23 and the surface thereof is maintained at a predetermined temperature suitable for fixing. The pressing roller 19 is indirectly heated by way of the heating roller 18, and the heating roller 18 and the pressing roller 19 are press-contacted with each other. Thereby, the toner configuring an unfixed image is melt-fixed, and the fixing of the image is performed on the sheet P. The pressing roller 19 is driven with the heating roller 18 by way of the sheet P in the sheet-passing region. In the fixing process, because the heating roller 18 does not have a portion where the heat capacity is relatively increased, a temperature distribution is stable in the longitudinal direction. Therefore, unevenness of the fixing is not caused and a temperature rise is rapidly performed, too. Because the heating roller 18 is shaped in a hand drum form, wrinkles of the sheet P are not caused when the sheet P passes the nip portion 46. The sheet P on which the toner image is fixed in the fixing process passes a pair of sheet rollers 20 and is ejected from an ejection opening 21 onto a paper eject tray 22 to be stacked with the face of the image facing down.

In the embodiments described above, a fixing device is described in which the heating roller 18 is a driving member and the pressing roller 19 is a driven member, respectively, and the radiation heater 23 as a heating element is arranged at the side of the driving member 6. However, substantially the same configuration can be practiced in a fixing device of a belt fixing type.

Figure 8:
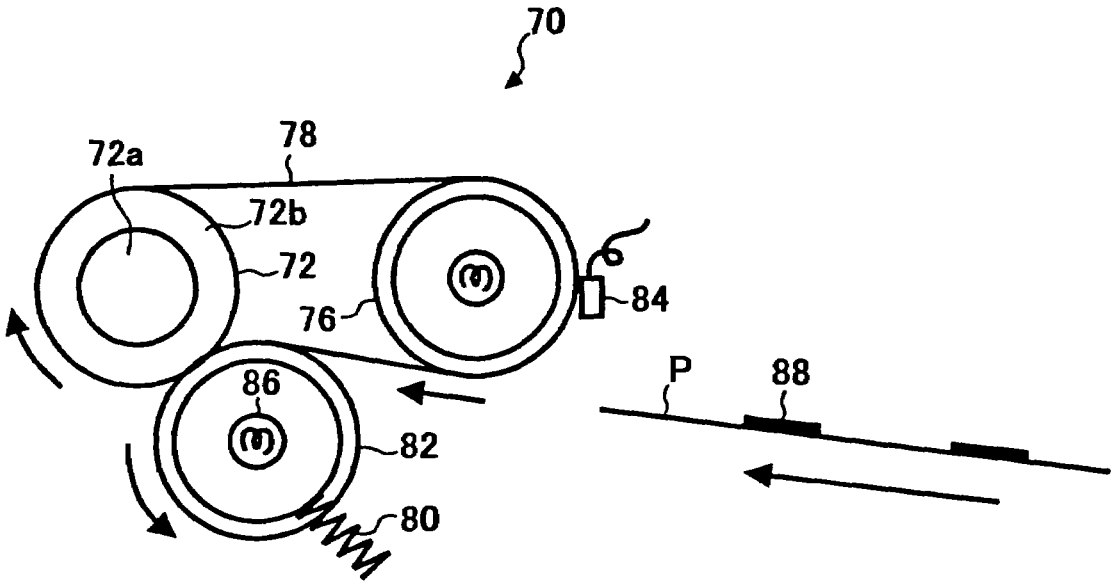
FIG. 8 is a schematic front view illustrating a fixing device of a belt fixing method of the present invention.

An embodiment of this type is illustrated in FIG. 8. A fixing device 70 in this embodiment is provided with a fixing roller 72, a heating roller 76 which has a halogen heater 74 as a heating element inside, an endless fixing belt 78 which is wound around the fixing roller 72 and the heating roller 76, a pressing roller 82 which is arranged so as to face the fixing roller 72 and which is press-contacted to the heating roller 72 sandwiching the fixing belt 78, by a pressing force of a spring 80, and a thermistor 84 which detects the temperature of the fixing belt 78 at the side of the heating roller 76. Inside the pressing roller 82, too, a halogen heater 86 is arranged in the same manner as the heating roller 76. The fixing roller 72 has a core 72*a* and an elastic material layer 72*b* which is formed around the outer circumference of the core 72*a*.

The sheet P on which a toner image is transferred and is carried, is conveyed in an arrow sign direction, and enters a nip portion of the fixing roller 72 and the pressing roller 82. When the sheet P passes the nip portion, it is heated and pressed so that the toner 88 is melt-fixed onto the sheet P.

Preferably, the fixing belt 78 is approximately 10–200 m in thickness, and has at least a base member of a metal belt such as stainless steel and nickel, or a film of heat resistant resin such as polyimide, and more preferably, a releasing layer such as silicon rubber and fluorine containing resin which is formed on the base member in order to increase the releasing property. The heating device has only to be installed in order to heat at least one of the driving member and the driven member.

As the sheet-like medium, those which can be used in the thermal fixing device as described above, such as an OHP sheet, an envelope, a cardboard and the like, can be used. As the image forming agent, not only toner but other agents can be used. An image which is formed by such an image forming apparatus may be a monochromatic image or a color image including a full-color image in this embodiment. Further, the image forming apparatus may be a type to form an image only on one side of the sheet-like medium, or a type to form images on both sides thereof. Further, in the fixing device, coating of a releasing agent onto a driving member is effective for improving the releasing property. A releasing agent-coating device may be arranged for a driven member, or for each of the driving member and the driven member of the fixing device when the image forming apparatus performs image formation for both sides of a sheet.

The embodiments described above are described with respect to the cases where a heating roller or a heating device of the present invention is applied to a fixing device. However, the heating roller or the heating device may be used in a thermal transfer device or a device for removing wrinkles of other sheet-like media, such as paper money, etc., and the use of the heating roller or the heating device is not limited to an image forming apparatus.

According to one aspect of the present invention, in a heating roller having a core and a hollow cylinder form, the thickness of the core is greater in a center portion than in both end portions. Therefore, even when a thin core is used, rigidity of a center portion in the longitudinal direction of the roller where stress causing bending or crushing concentrates is improved. Thus, a partial increase of heat capacity is suppressed, and simultaneously the deformation caused by the bending or the crushing is prevented from occurring.

Because the heating roller contacts bearings and gears in both end portions thereof, heat conducts to the bearings and the gears when the temperature rises, and the temperature in the longitudinal direction immediately after heating tends to be lower in the end portions than in the center portion. In order to solve the failure, conventionally the exothermic distribution in the longitudinal direction of the heater which is set inside the roller is set larger in the end portions than in the center portion. In the present invention, because the thickness of the core is greater in the center portion than in the end portions, even when the heat capacity of the end portions is small and the exothermic distribution of the heater is flat, the temperature distribution in the longitudinal direction immediately after heating can be uniform.

According to another aspect of the present invention, in the heating roller, the inside diameter of the core is smaller in the center portion than in the end portions. Therefore, the thickness of the core can be greater in the center portion than in the end portions without making the outside diameter in the center portion larger than in the end portions.

According to another aspect of the present invention, in the heating roller, the outside diameter of the core is substantially constant in the shaft direction. Therefore, manufacturing can be easy.

According to another aspect of the present invention, in the heating roller, the outside diameter of the core is smaller in the center portion than in the end portions. Therefore, wrinkles can be prevented by the hand drum form.

According to another aspect of the present invention, in the heating roller, the thickness of the core increases continuously from the end portions toward the center portion. Therefore, a partial increase of the heat capacity can be further suppressed.

According to another aspect of the present invention, in the heating roller, the difference of the core between the end portions and the center portion is configured so that the nip width of the center portion can be substantially the same as that of the end portions and the temperature difference in the longitudinal direction of the roller during heating can be in a predetermined range. Therefore, the heating time can be shortened and the fixing failure can be prevented.

According to another aspect of the present invention, after a member of a hollow cylinder form is process by drawing, an outer circumference surface thereof is processed by cutting, and thereby the core is made and the heating roller is manufactured from the core. Therefore, a manufacturing method of low cost which is relatively easy and is suitable for mass-production can be achieved without greatly changing a conventional manufacturing process of a roller.

According to another aspect of the present invention, the configuration has the heating roller and the heating device using this heating roller. Therefore, a heating device which obtains the technical advantages described above can be provided.

According to another aspect of the present invention, the configuration has the heating roller or the heating device, and has the pressing roller which contact-presses this heating roller. Therefore, a fixing device which obtains the technical advantages described above can be provided.

According to another aspect of the present invention, the configuration has the heating roller, the heating device or the fixing device. Therefore, an image forming apparatus which obtains the technical advantages described above can be provided.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Application Nos. 2000-187,045 & 2001-141,459 filed in the Japanese Patent Office on Jun. 22, 2000 & May 11, 2001, and the entire contents of which are hereby incorporated by reference.

What is claimed as new and is desired to be secured by Letter Patent of the United State is:

1. A method of producing a heating roller, comprising:

drawing a core of hollow cylinder form by engaging an outer circumference surface of the hollow cylinder form with a ring-shaped member, moving the ring-shaped member and the hollow cylinder form relative to one another in a longitudinal direction of the hollow cylinder form, and changing a diameter of the ring-shaped member during the relative movement; and cutting an outer circumference surface of the core;

wherein a thickness of the core is greater in a center portion thereof than in end portions thereof, and wherein in the drawing step, the core is drawn such that an inside diameter of the core is smaller in the center portion thereof than in the both end portions thereof.

2. The method of producing a heating roller of claim 1, wherein in the cutting step, the core is cut such that an outside diameter of the core is substantially constant in a shaft direction of the core.

3. The method of producing a heating roller of claim 1, wherein in the cutting step, the core is cut such that an outside diameter of the core is smaller in the center portion thereof than in the end portions thereof.

* * * * *